US007744057B2

(12) United States Patent
Schwoerer

(10) Patent No.: US 7,744,057 B2
(45) Date of Patent: Jun. 29, 2010

(54) CURVED CONCRETE FORMWORK

(75) Inventor: Artur Schwoerer, Senden (DE)

(73) Assignee: Peri GmbH, Weissenhorn (DE)

( * ) Notice: Subject to any disclaimer, the term of this patent is extended or adjusted under 35 U.S.C. 154(b) by 1051 days.

(21) Appl. No.: 10/582,772

(22) PCT Filed: Nov. 27, 2004

(86) PCT No.: PCT/DE2004/002631

§ 371 (c)(1),
(2), (4) Date: Jun. 13, 2006

(87) PCT Pub. No.: WO2005/059271

PCT Pub. Date: Jun. 30, 2005

(65) Prior Publication Data

US 2007/0108367 A1 May 17, 2007

(30) Foreign Application Priority Data

Dec. 16, 2003 (DE) ..... 103 58 886

(51) Int. Cl.
*E04G 11/08* (2006.01)

(52) U.S. Cl. ..... 249/194; 249/219.1

(58) Field of Classification Search ..... 249/219.1, 249/219.2, 44, 47, 192, 194; 264/32
See application file for complete search history.

(56) References Cited

U.S. PATENT DOCUMENTS

| | | | | |
|---|---|---|---|---|
| 4,915,345 | A * | 4/1990 | Lehmann | 249/18 |
| 6,581,898 | B2 * | 6/2003 | McCracken | 249/189 |

FOREIGN PATENT DOCUMENTS

| | | | | |
|---|---|---|---|---|
| DE | 3734301 | * | 4/1988 | 249/47 |
| DE | 89 08 345 | | 11/1989 | |
| EP | 0807501 | * | 11/1997 | 249/219.1 |
| EP | 1 321 601 | | 6/2003 | |
| GB | 1495862 | * | 12/1977 | 249/194 |
| GB | 2133826 | * | 8/1984 | 249/47 |

* cited by examiner

*Primary Examiner*—Michael Safavi
(74) *Attorney, Agent, or Firm*—Paul Vincent

(57) ABSTRACT

A transverse bolt (1) is to be fastened to a formwork element (110, 120) of a concrete formwork (100), preferably a curved concrete formwork. The transverse bolt (1) comprises a first end section located at a first end of the transverse bolt (1), in the longitudinal direction thereof, having at least one elongated hole, and at least one round hole. A curved concrete formwork comprises formwork elements (110, 120) that are provided with such a transverse bolt. A bolt fixture (2), by means of which the transverse bolt (1) can be fastened to the formwork element (110, 120) of the curved concrete formwork, is arranged on the transverse bolt. The elongated hole (3) and the round hole (4) are preferably located next to each other in the longitudinal direction of the transverse bolt (1) in the first final section of the transverse bolt (1).

13 Claims, 6 Drawing Sheets

CURVED CONCRETE FORMWORK

This application is the national stage of PCT/DE2004/002631 filed on Nov. 27, 2004 and claims Paris Convention priority of DE 103 58 886.8 filed Dec. 16, 2003.

BACKGROUND OF THE INVENTION

The invention concerns a curved concrete formwork having a transverse bolt for attachment to a formwork element of the curved concrete formwork, each transverse bolt having a first end region at a longitudinal first end thereof, wherein the transverse bolt has at least one elongated hole and at least one round hole. A bolt fixture for fixing the transverse bolt to the formwork element of the curved concrete formwork is also disposed or formed on the transverse bolt. Curved concrete formworks of this type are used for molding curved or bent walls.

G 89 08 345 U1 discloses transverse bolts for a curved concrete formwork, and a curved concrete formwork. The transverse bolts have round holes and neighboring transverse bolts are connected via a telescopic spindle configuration to a spindle screwed into threaded screw holes of bolts, wherein the bolts are inserted into the round holes of the transverse bolts. This curved concrete formwork is disadvantageous in that neighboring transverse bolts have to be fixed by a further stabilizing transverse bolt in order to stabilize the transverse bolts. This increases both the assembly effort as well as the depth of the concrete wall formwork, which is disadvantageous, in particular, when only little space is available.

EP 1 321 601 A1 discloses a transverse bolt of this type. An end region of the transverse bolt is mounted to a longitudinal bolt of the curved concrete formwork via a bolt guided through an elongated hole, and a further end region of the transverse bolt is mounted to a second longitudinal bolt via a bolt guided through a round hole. The transverse bolt comprises a bolt fixture for mounting to the curved concrete formwork via a telescopic spindle configuration. This curved concrete formwork is also disadvantageous since respective neighboring transverse bolts have to be fixed with a further transverse bolt in order to stabilize the transverse bolts. Moreover, the stabilizing transverse bolts of EP 1 321 601 A1 are also connected to each other using telescopic spindle configurations. This configuration requires a great deal of assembly effort by specially trained staff.

EP 0 807 501 A and GB 1 001 768 A each disclose a curved concrete formwork having transverse bolts, whereby the transverse bolts each have a longitudinal hole and/or a round hole on their respective ends. Neighboring transverse bolts of the curved formwork are disposed with overlapping ends in such a fashion that the round holes and/or the longitudinal holes form through holes for bolts. EP0807501A requires differing transverse bolts to be connected to each other. The transverse bolts of GB 1 001 768 A must be screwed together at the bolt through holes in order to fix and define the curvature of the curved formwork.

It is the underlying purpose of the invention to provide a concrete wall formwork that overcome the disadvantages of prior art, which are particularly simple and inexpensive to use, and which require minimum depth.

SUMMARY OF THE INVENTION

This object is achieved by the devices of the independent claims. The dependent claims show preferred embodiments of the invention.

The object is achieved with respect to the transverse bolt in that the transverse bolt comprises a bolt fixture for mounting the transverse bolt to a formwork element of a concrete formwork, preferably a curved concrete formwork, and a first transverse bolt end region located at a first longitudinal end of the transverse bolt, wherein the transverse bolt has at least one elongated hole and at least one round hole.

The elongated hole and the round hole are disposed next to each other in the first end region of the transverse bolt, preferably, in the longitudinal direction of the transverse bolt. The transverse bolt is thereby preferably formed from one piece and produced e.g. from steel.

The object is achieved with respect to the curved concrete formwork in that inventive transverse bolts are mounted to a curved concrete formwork comprising at least one formwork element with a formwork shell in such a manner that an end of a first transverse bolt at least partially overlaps an end of a second transverse bolt. The elongated hole of the first end of the transverse bolt thereby overlaps the round hole of the second end of the transverse bolt in such a manner that a first bolt duct is formed and the elongated hole of the second end of the transverse bolt overlaps the round hole of the first end of the transverse bolt in such a manner that a second bolt duct is formed.

The bolt sections consisting of individual such transverse bolts form a bending-resistant transverse bolt composite due to the overlapping, wherein the bolt sections can be angled relative to each other within the scope of the travel of the elongated holes when the bolts are inserted into the bolt ducts. The inventive curved concrete formwork can be used both as interior and exterior formwork. The bend of the curved concrete formwork is shaped by the composite of transverse bolts and edge transverse bolts together and not by the formwork shell itself. The formwork shell can be easily exchanged when required.

The inventive transverse bolts overlap at their ends. The elongated hole and the round hole at end regions of the transverse bolts may thereby be disposed on top of each other such that they form bolt ducts, wherein the elongated hole of a first inventive transverse bolt seats on the round hole of a second inventive transverse bolt. The transverse bolts are then connected to each other via bolts at the overlapping transverse bolt ends, the bolts being guided through the transverse bolt ends and the rocker-shaped elongated holes. The transverse bolt ends are then connected to each other in such a manner that they can accept a bending moment, and still be mutually angled and telescoped. During telescoping, the connected transverse bolts assume a defined angular shape. Additional stabilization of neighboring transverse bolts may then be omitted. This reduces the structural size of a curved concrete formwork, since only one transverse bolt position is required. This is advantageous for transporting the concrete wall formwork or the formwork elements from which the concrete wall formwork is made, and for encasing a curved concrete formwork to be filled with concrete when only little space is available. Moreover, mounting of the concrete wall formwork is facilitated and accelerated.

The inventive transverse bolt preferably comprises a second transverse bolt end region at a second transverse bolt end disposed opposite to the first end of the transverse bolt in a longitudinal direction, wherein the end regions of the transverse bolt each have at least one round hole disposed next to at least one elongated hole, preferably in the longitudinal direction of the transverse bolt. Transverse bolts of this type can be joined on both longitudinal sides with their ends overlapping each other. This yields a transverse bolt composite which is assembled from many transverse bolts. In order to be able to use transverse bolts of identical construction for joining the transverse bolt composite, the elongated holes and the round holes are preferably mirror symmetrical with respect to each other.

The bolt fixture preferably has the shape of a hat or trapezoid, which facilitates transmission of a bending moment exerted by the transverse bolt onto the formwork shell of the curved concrete formwork.

The bolt fixture of the transverse bolt advantageously comprises openings for the passage of screws for mounting the transverse bolt to the curved concrete formwork for mounting the inventive transverse bolts at predetermined mounting points on the concrete wall formwork. Rigid mounting permits defined transmission of bending moments onto the formwork shell, i.e. the shape of the formwork shell can be exactly adjusted. The bolt fixture is preferably disposed on the transverse bolt in a central region of the transverse bolt, between the transverse bolt ends. This allows symmetrical transmission of the bending moment which is advantageous in particular for curved concrete formworks encasing circular concrete shapes.

In a further embodiment, the transverse bolt comprises a second transverse bolt end opposite to the first transverse bolt end in the longitudinal direction of the transverse bolt, wherein the transverse bolt fixture is disposed or formed on the second end of the transverse bolt. Viewed in the longitudinal direction of the transverse bolt, the bolt fixture is then formed opposite to the first end of the transverse bolt. A transverse bolt of this type is suitable as a transverse bolt for the edge of a curved concrete formwork. The transverse bolt may be mounted to the edge of the curved concrete formwork in such a manner that it does not project past the edge to yield flush encasing with other formwork elements.

The bolt fixture of the edge transverse bolt is preferably connected, in particular welded, to the edge support element. An edge support element of this type is preferably designed to adopt the function of a longitudinal bolt, i.e. the formwork shell to which it is fastened, is reinforced in the longitudinal direction, perpendicularly to the transverse bolts or to their orientation on the formwork shell. This embodiment facilitates assembly of the edge transverse bolt.

The transverse bolt is preferably formed as a U-shaped profiled section or comprises a U-shaped profiled section, wherein the end regions of the transverse bolt ends are each formed as extension of both legs of the U-shaped profiled section. The elongated hole and the round hole in one end region of the transverse bolt each penetrate through both extensions of the end of the transverse bolt to form bolt ducts. This embodiment provides a transverse bolt having a high bending resistance while using little material and having low weight. A transverse bolt of this type may be produced from a sheet metal through punching and/or bending processes. Since the holes penetrate through both extensions, jamming of a bolt guided through the holes is prevented and the bolt is safely guided.

In an inventive transverse bolt, the bolt fixture is rigidly connected, preferably welded, to the transverse bolt. The rigid connection permits exact transmission of a bending moment exerted by the transverse bolts onto the formwork shell, wherein torsion-proof connection between the inventive transverse bolt and the concrete wall formwork is ensured. Welding the bolt fixture to the transverse bolt minimizes the assembly work, while at the same time ensuring very reliable connection.

With particular preference, the rocker-shape of the elongated hole(s) has at least one bend in its longitudinal direction, wherein the shape of the bend corresponds to the round shape of a concrete wall to be molded by the concrete wall formwork. This provides a guiding function in the elongated hole during telescoping of the spindle configuration to greatly facilitate assembly of the curved concrete formwork.

The overlapping ends of the transverse bolts of an inventive curved concrete formwork are preferably connected, via a telescopic spindle configuration, to a spindle which connects two bolts. The bolts are thereby disposed in the first and second bolt ducts. This configuration permits flexible adjustment of a radius of curvature of the formwork shell through simple telescoping of the spindle configuration.

In a preferred embodiment, the bolts of the spindle configuration each have a threaded screw hole, wherein the spindle is screwed into the threaded screw holes and one of the threaded screw holes is designed as left-hand thread and the other as right-hand thread. This is a simple and proved spindle configuration which permits very rigid shaping of the overall transverse bolt.

Support elements and edge support elements are preferably mounted to the formwork shell of the formwork elements of the inventive curved concrete formwork, wherein the bolt fixtures of the transverse bolts are mounted to the support elements or edge support elements. The support elements preferably function as longitudinal bolts. Damage to the formwork shell during mounting of the curved concrete formwork can be prevented by mounting the inventive transverse bolts to existing support elements and not directly to the formwork shell. With particular preference, the support elements function as longitudinal bolts, thereby fulfilling two functions. No additional elements are required. The longitudinal supports of the curved concrete formwork, which are required in any event, may also serve as support elements for the inventive transverse bolts. The inventive transverse bolts are rigidly mounted to the support elements, in particular, in a torsion-proof fashion.

The support elements preferably have recesses for passage of tie bolts and/or for mounting working platforms and/or for connecting any connecting elements. In this fashion, the stable support function of the support elements can be used for other purposes.

With particular advantage, at least one transverse bolt is mounted to the edge support element, which is formed as edge transverse bolt, wherein the edge support element comprises a resilient shackle which is disposed on a side of the edge support element facing away from the edge of the formwork shell. The shackle is mounted to the formwork shell and designed in such a manner that the shackle follows the bending direction of the formwork shell when a load is applied onto the shackle via the transverse bolt. The edge profile is rigidly mounted to an edge of the formwork shell, wherein at least one inventive edge transverse bolt is mounted to the edge support element. The edge support element comprises a resilient shackle which is disposed on a side of the edge support element facing away from the edge of the formwork shell. The shackle is mounted to the formwork shell in such a manner that, upon exertion of pressure on the shackle towards the formwork shell, a bending moment is exerted onto the formwork shell. This edge support element may also be used without the transverse bolt. The bending motion forced upon the formwork shell thereby advantageously extends to the edge of the formwork shell. If no shackle is provided, forced bending terminates in a tangential direction at the edge of the formwork shell. This means, the bend merges into a straight section of variable width on the edge of the formwork shell. The resilient shackle provides a round shape up to the edge of the formwork shell. The formwork shell is connected to the edge profile of the edge support element in a bending-resistant fashion, but the round shape continues to the edge of the formwork shell due to the resilient shackle. The shackle is pressed against the formwork preferably via an edge transverse bolt mounted to the edge support element. The edge support profiles reinforce the edge of the formwork shell, at the same time continuing the desired bend to the edge of the formwork shell.

Further advantages can be extracted from the description and the attached drawings. The features of the invention mentioned above and below may be used individually or collectively in combination. The mentioned embodiments are not to be taken as exhaustive enumeration but have exemplary character.

The invention is described in more detail below with embodiments and reference to the drawing.

DESCRIPTION OF THE PREFERRED EMBODIMENT

Figure 1:
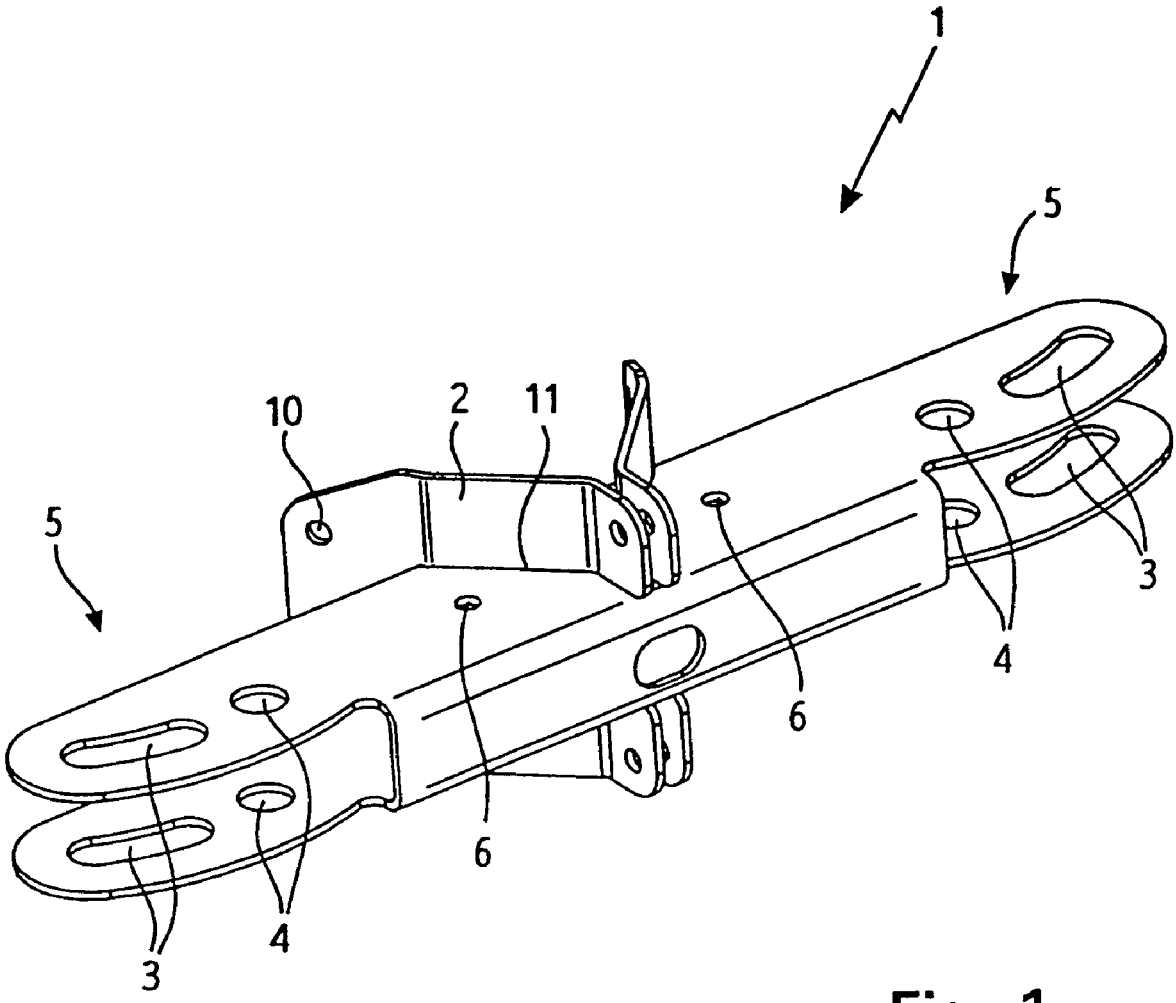
FIG. 1 shows an inventive transverse bolt comprising two bolt ends, each having one round hole and one elongated hole in the end sections of the transverse bolt.

The figures of the drawing show the inventive subject matter in a highly schematic fashion and are not to be taken to scale. The individual components of the inventive subject matter are represented to clearly show their construction.

FIG. 1 shows an inventive transverse bolt 1 with a trapezoidal bolt fixture 2 in the region of the center of the transverse bolt, and two transverse bolt ends, each having an elongated hole 3 and a round hole 4 in end regions 5 of the transverse bolts. The end regions 5 of the transverse bolts are each located at an end of the transverse bolt 1 and are disposed opposite to each other in the longitudinal direction of the transverse bolt 1. Mounting points 6 are provided on the transverse bolt 1 and are designed as drilled holes. Any connecting elements may be fixed to these mounting points 6. The bolt fixture 2 has openings 10 for mounting the transverse bolt 1 to a curved concrete formwork, e.g. a longitudinal bolt of the curved concrete formwork. Screws may e.g. be guided through these openings 10 for screwing the transverse bolt 1 to the curved concrete formwork. The bolt fixture 2 is formed by a U-shaped profiled section and connected to the transverse bolt 1 via a welding seam 11. The end regions 5 of the transverse bolt are designed as extensions of the legs of the U-shaped profiled section, with the round hole 4 and the elongated hole 3 each penetrating through both extensions. The round holes 4 and the elongated holes 3 are disposed next to each other in the longitudinal direction of the transverse bolt 1. The elongated hole 3 in the end region 5 of the transverse bolt is closer to the respective transverse bolt end than the round hole 4. The rocker-shape of the elongated holes 3 has a bend in the longitudinal direction thereof, which is designed to correspond to the shape of a curved concrete wall being poured.

Figure 2:
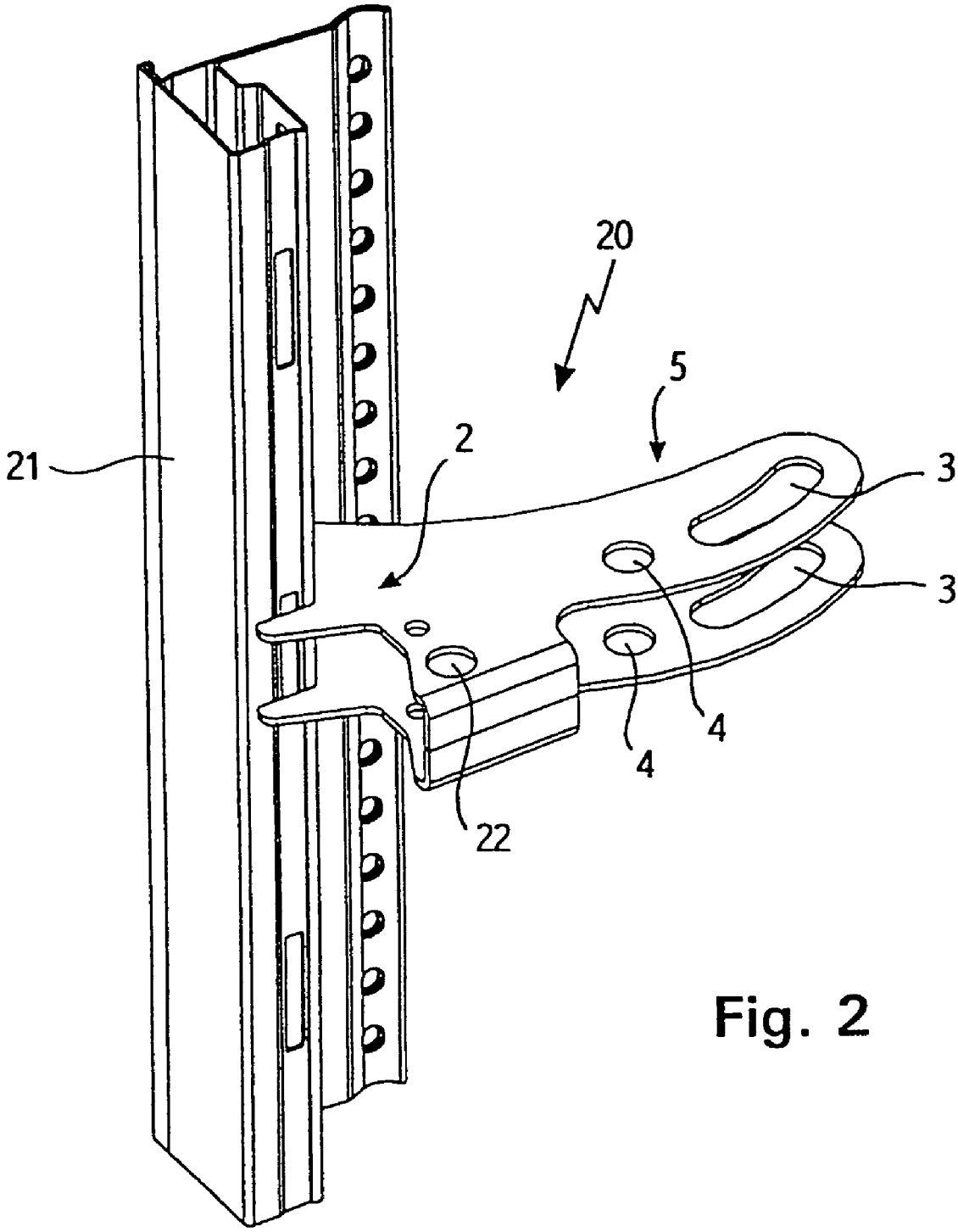
FIG. 2 shows an inventive transverse bolt designed as an edge transverse bolt.

FIG. 2 shows an inventive transverse bolt which is designed as an edge transverse bolt 20. The edge transverse bolt 20 comprises a transverse bolt end also having an elongated hole 3 and a round hole 4 in an end region 5 of the transverse bolt, and a bolt fixture 2 on the transverse bolt end opposite thereto. The bolt fixture 2 is connected to a support element 21 in the edge region of a curved concrete formwork. A round edge connection hole 22 is also provided on the edge transverse bolt 20, into which e.g. a bolt can be inserted. Curved concrete formwork elements each comprising inventive edge transverse bolts 20 can be connected to each other via the round holes 22 of the edge transverse bolts 20 connecting the edges, preferably using a telescopic spindle configuration.

Figure 3A:
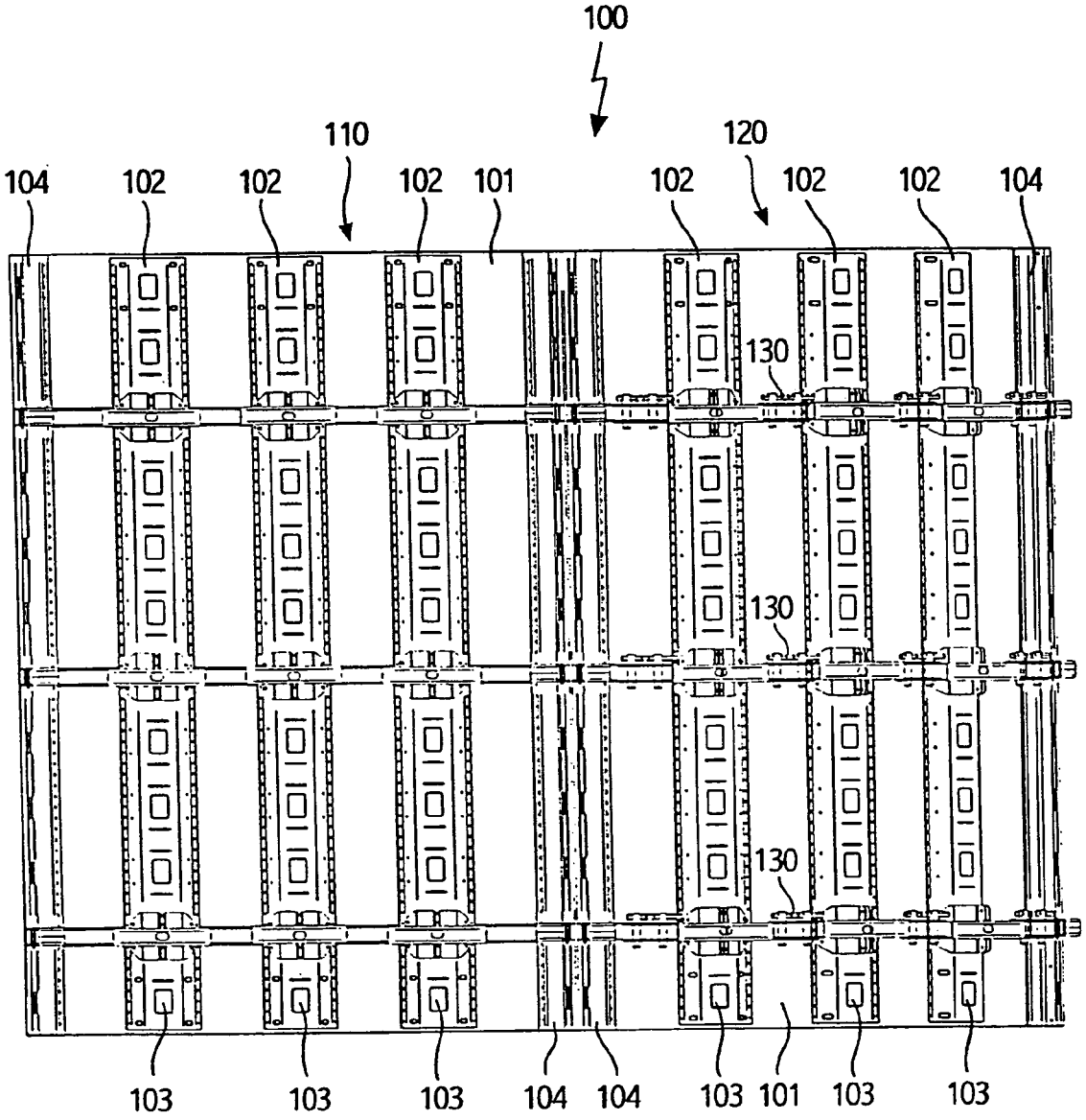
FIGS. 3*a* and 3*b* show an inventive curved concrete formwork in two different views.
Figure 3B:
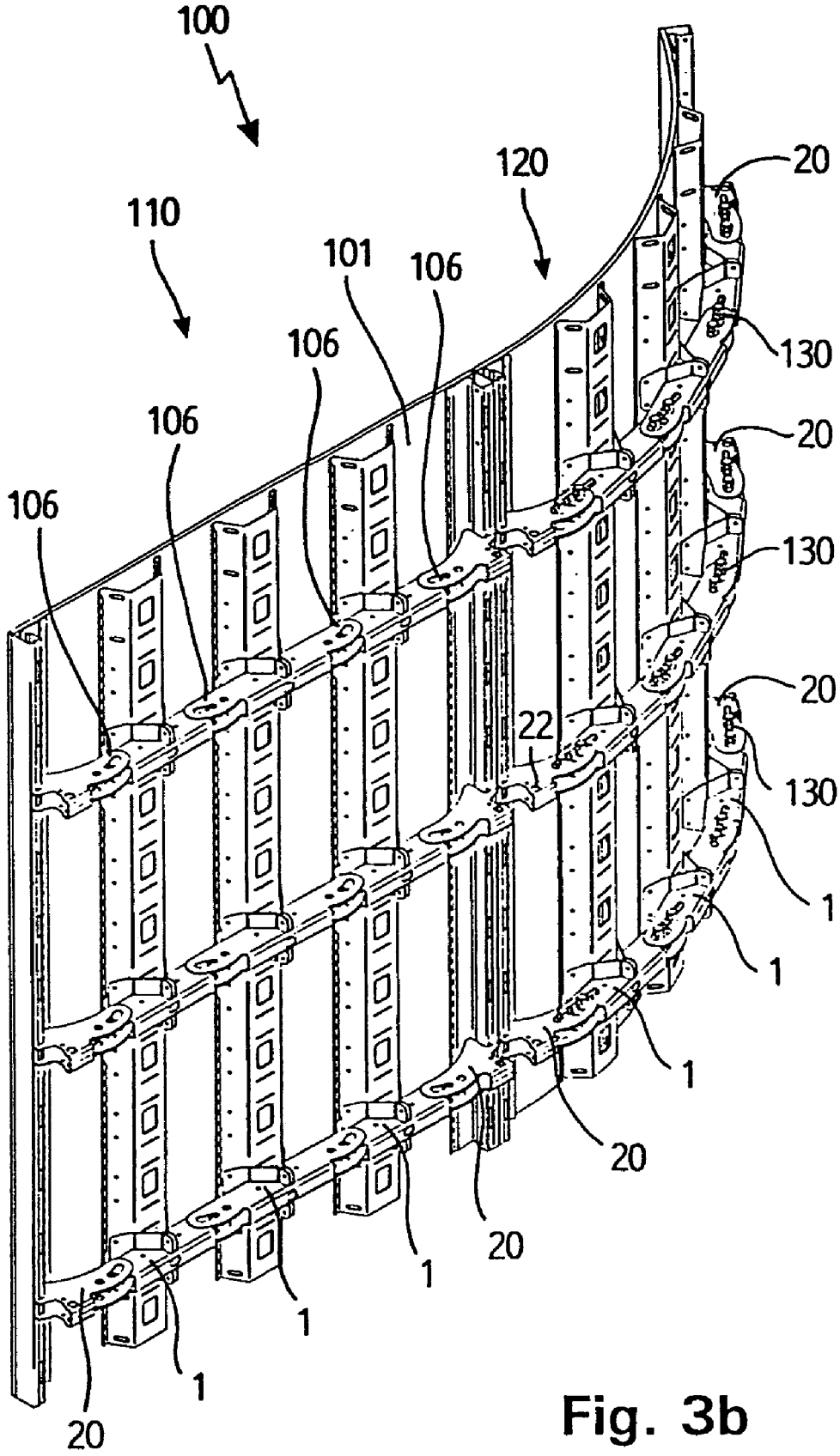

FIGS. 3*a* and 3*b* each show an inventive curved concrete formwork 100. FIG. 3*a* shows a front view of the curved concrete formwork 100 and FIG. 3*b* shows a perspective inclined view of the curved concrete formwork 100. The curved concrete formwork 100 consists of two partial curved concrete formworks (formwork elements 110, 120). The formwork elements 110, 120 each comprise three support elements 102 functioning as longitudinal bolts. Recesses 103, e.g. for passage of concrete formwork tie bolts (not shown) are disposed in the support elements 102. The support elements 102 are shaped as trapezoidal profiles, in correspondence with the shape of the bolt fixtures 2. For this reason, the trapezoidal bolt fixtures 2 can e.g. be rigidly bolted to the support elements 102 with exact fit. The edge support elements 104 disposed on the edges in the bending direction of the formwork elements 110, 120 are formed as edge profiles. Each formwork element 110, 120 of the curved concrete formwork 100 comprises a configuration formed from three inventive transverse bolts 1. Three inventive transverse bolts 1 are mounted to each support element 102 along the height of the curved concrete formwork 100. Three edge transverse bolts 20 are mounted to each of the edges of the respective formwork elements 110, 120 along the height of the formwork elements 110, 120. Neighboring transverse bolts 1 and edge bolts 20 disposed next to the transverse bolts 1 overlap each other at abutting transverse bolt ends 106. The overlapping transverse bolt ends 106 may e.g. be pushed on top of each other. In this case, the transverse bolt ends 106 may all have the same shape. The transverse bolt ends 106 may, however, also be pushed into each other. In this case, the transverse bolt ends 106 must have different dimensions such that a narrower transverse bolt end 106 can be pushed into a wider transverse bolt end 106. In the latter case, either each transverse bolt 1 may comprise a narrower and a wider transverse bolt end 106 or two transverse bolts 1 with different dimensions are used, wherein one transverse bolt 1 comprises narrower bolt ends 106 and the other comprises wider transverse bolt ends 106. The overlapping transverse bolt ends 106 overlap in such a fashion that the elongated hole of the transverse bolt end comes to seat on the round hole of the neighboring transverse bolt end. One pair of overlapping transverse bolt ends 106 thereby forms two bolt ducts, wherein the bolt ducts are maintained during flexible bending of the formwork shell 101, since there is one elongated hole for each bolt duct. In the formwork element 120 on the right-hand side in the figure, the overlapping transverse bolt ends 106 are each connected via a telescopic spindle configuration 130. This formwork element 120 is shown in the readily assembled state. The spindle configuration 130 consists of a spindle 131 and two bolts 132 with threaded screw holes into which the spindle 131 is screwed (see also FIG. 4*a*). Each bolt 132 is guided through a bolt duct. The spindle 131 has a right-hand thread on one side and a left-hand thread on the other side.

By turning the spindle 131 about its longitudinal axis, the spindle configuration 130 is telescoped, i.e. it is lengthened or shortened, depending on the direction of rotation, and the curvature of the transverse bolt composite can be adjusted, wherein this curvature is imposed upon the formwork shell 101. Neighboring edge transverse bolts 20 of the two formwork elements 110, 120 may also be connected to each other via such a spindle configuration 130, wherein one of the two bolts is inserted into an edge connecting hole 22 of a neighboring edge transverse bolt 20. Through telescoping of the spindle configuration 130 used in connection with edge transverse bolts 20, the transition of the formwork shells 101 of the abutting formwork elements 110, 120 may be adjusted almost continuously, i.e. without steps. It is clear that the abutting formwork elements 110, 120 are held together via conventional turnbuckles (not shown in the drawing).

Figure 4A:
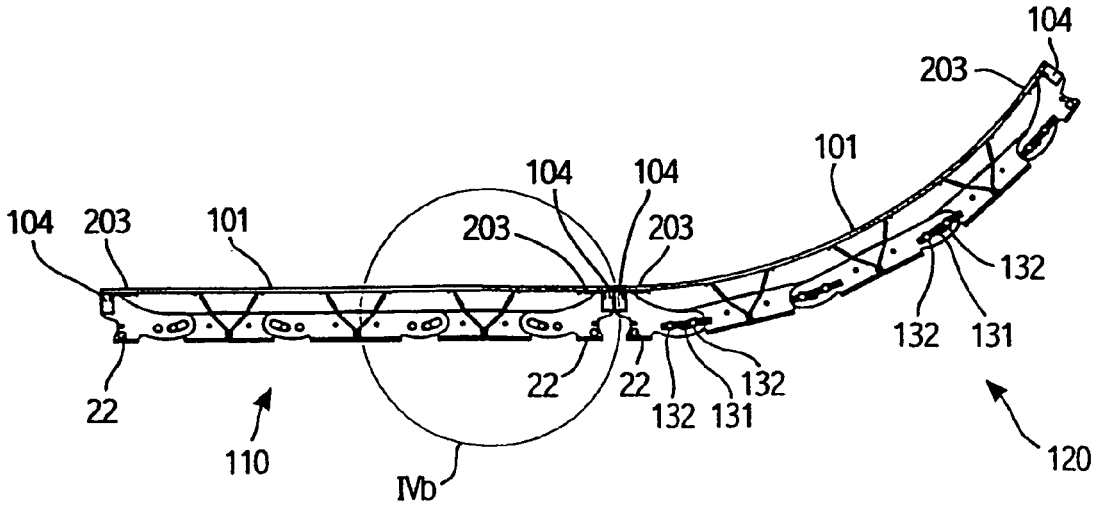
FIG. 4*a* shows a cross-sectional view of the inventive curved concrete formwork of FIG. 3 along a transverse bolt composite composed of several inventive transverse bolts.
Figure 4B:
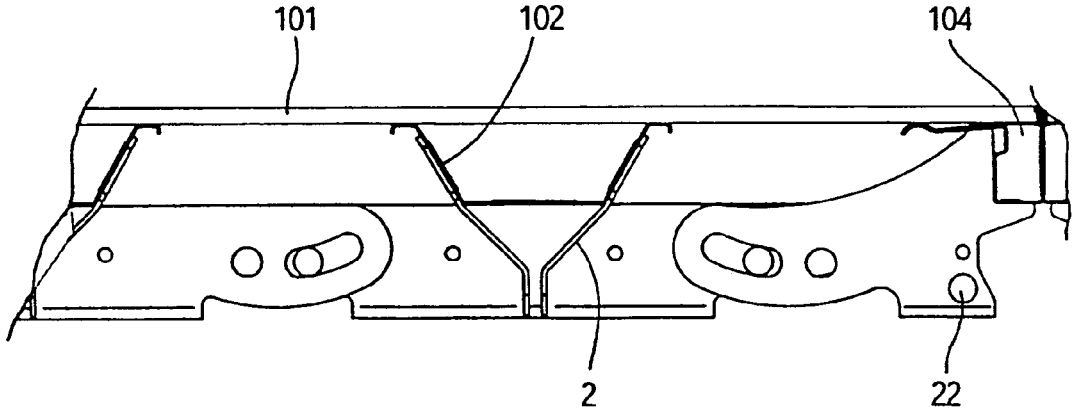
FIG. 4*b* shows a detail of FIG. 4*a*.

FIG. 4*a* shows the inventive curved concrete formwork of FIG. 3 in a cross-sectional view along a transverse bolt composite formed from several inventive transverse bolts 1, 20. FIG. 4*b* shows a detail IVb of FIG. 4*a* with an inventive transverse bolt 1 and an inventive edge transverse bolt 20. The transverse bolt composite spans both formwork elements 110, 120. It consists of three inventive transverse bolts 1 and two inventive edge transverse bolts 20 for each formwork element 110, 120. The neighboring transverse bolts 1 and transverse bolts 1 with edge transverse bolt 20 overlap in their end regions. The overlapping transverse bolt ends are connected to telescopic spindle configurations 130 in the region of the right-hand formwork element 120. One edge support element 104 is mounted to each edge of the formwork shell 101 in the bending direction. The edge support elements 104 (edge profile) have a resilient shackle 203 facing the formwork shell 101 to which they are mounted. The edge transverse bolt 20 mounted to the associated edge support element 104 together with the formwork shell rear grip forces the resilient shackle 203 towards the formwork shell 101, such that a bending moment is exerted onto the formwork shell 201. Each bordering formwork element 110, 120 abuts one edge support element 104. FIG. 4*b* clearly shows precise fitting of a trapezoidal bolt fixture 2 to a trapezoidal support element 102.

Figure 5:
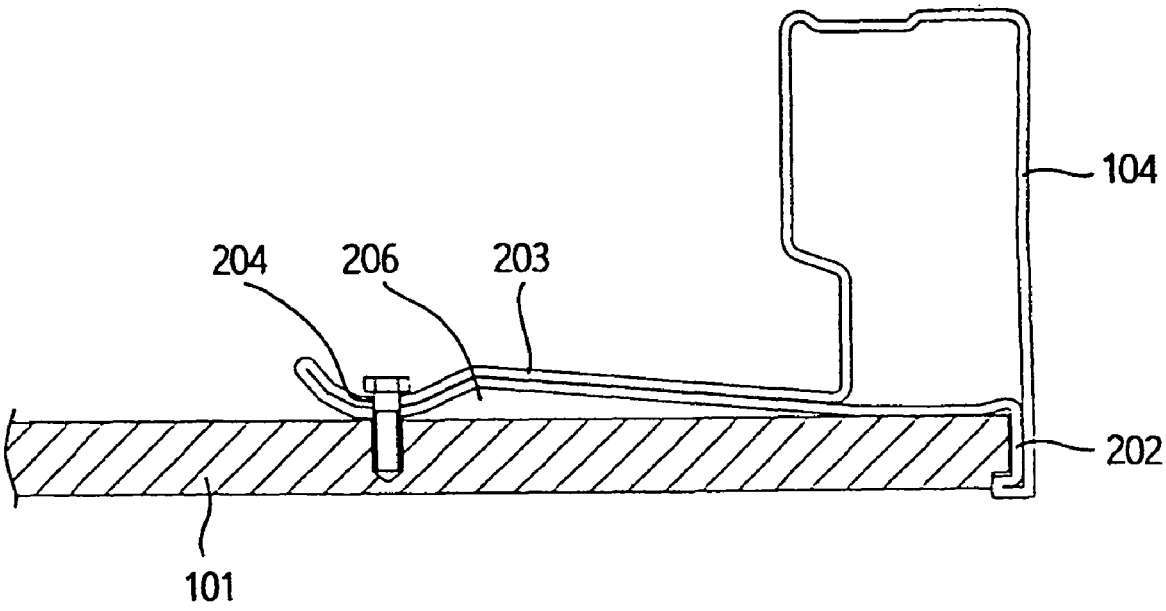
FIG. 5 shows a cross-section through an edge support element having a resilient shackle.

FIG. 5 shows a cross-section through an edge support element 104 with a resilient shackle 203 (shown in FIGS. 4*a* and 4*b*). An edge support element 104 of this type may also be used for curved concrete formworks having no inventive transverse bolts. A curved concrete formwork comprising such an edge support element 104 therefore represents an independent invention. The edge support element 104 is formed as an edge profile. The edge support element 104 also comprises the resilient shackle 203. The resilient shackle 203 and the formwork shell 101, via which the formwork shell 101 is mounted to the edge support element 104, define a space 206. The edge support element 104 has a mounting hole 204 on the resilient shackle 203. The shackle 203 may be screwed to the formwork shell 201 at this mounting hole 204. The edge support element 104 also comprises a rail 202 at the edge profile, surrounding an edge of the formwork shell 101. The longitudinal extension of the rail 202 on the inner side directly facing the formwork shell 101 corresponds to the thickness of the formwork shell 101 and its outer edge is almost flush with the formwork shell 101. When an edge transverse bolt is welded to the edge support element 104, this region of the space 206 presses against the shackle 203. Since the shackle 203 is rigidly screwed to the formwork shell 101, a bending moment is exerted onto the formwork shell 101. This extends the desired curvature of the curved concrete formwork to the edge of the formwork shell 101.

The invention is not limited to the above-mentioned embodiment. A number of variants are feasible which may utilize the features of the invention even if they have a fundamentally different design.

The invention proposes a transverse bolt 1 for mounting to a formwork element 110, 120 of a concrete formwork 100, preferably a curved concrete formwork, comprising a first transverse bolt end region at a first end of the transverse bolt disposed in the longitudinal direction of the transverse bolt 1, wherein the transverse bolt 1 has at least one elongated hole and at least one round hole, and a curved concrete formwork of formwork elements 110, 120 comprising such transverse bolts. A bolt fixture 2 for mounting the transverse bolt 1 to the formwork element 110, 120 of the curved concrete formwork is furthermore disposed on the transverse bolt. The elongated hole 3 and the round hole 4 are disposed next to each other in the first end region of the transverse bolt, preferably in the longitudinal direction of the transverse bolt 1.

I claim:

1. A curved concrete formwork having at least one formwork element, the formwork comprising:

a first transverse bolt, said first transverse bolt having a bolt fixture for mounting said first transverse bolt to the formwork element, said first transverse bolt defining at least one first elongated hole and at least one first round hole disposed at a first longitudinal end thereof, said first elongated hole being curved in a shape corresponding to a rounded shape of a concrete wall formed by the concrete formwork;

a second transverse bolt, said second transverse bolt defining at least one second elongated hole and at least one second round hole disposed at a second longitudinal end thereof, said second elongated hole being curved in a shape corresponding to the rounded shape of the concrete wall formed by the concrete formwork, wherein said first longitudinal end at least partially overlaps said second longitudinal end, said first elongated hole overlapping said second round hole to define a first bolt duct, and said first round hole overlapping said second elongated hole to define a second bolt duct;

a first connecting means disposed within said first duct;

a second connecting means disposed within said second duct; and a spindle disposed between and cooperating directly with said first and said second connecting means for adjusting a curvature of the concrete wall.

2. The curved concrete formwork of claim 1, wherein said first elongated hole and said first round hole are disposed next to each other in a longitudinal direction of said first transverse bolt.

3. The curved concrete formwork of claim 1, wherein said first transverse bolt defines at least one third round hole and at least one third elongated hole disposed at a third longitudinal end thereof which is opposite to said first longitudinal end.

4. The curved concrete formwork of claim 3, wherein said bolt fixture has a hat or trapezoid shape.

5. The curved concrete formwork of claim 4, wherein said bolt fixture defines openings to pass a screw for mounting said first transverse bolt to the formwork element.

6. The curved concrete formwork of claim 3, wherein said bolt fixture is disposed on said first transverse bolt in a central region thereof.

7. The curved concrete formwork of claim 1, wherein said first transverse bolt is an edge transverse bolt, wherein said bolt fixture is disposed in a fourth longitudinal end region of said first transverse bolt which is opposite to said first longitudinal end region.

8. The curved concrete formwork of claim 3, wherein said first transverse bolt is designed as a U-shaped profiled section and each of said first and said third end regions are extensions of both legs of said U-shaped profiled section, wherein said first elongated hole and said first round hole penetrate through both extensions of said first transverse bolt end to form bolt ducts and said third elongated hole and said third round hole penetrate through both extensions of said third transverse bolt end to form bolt ducts.

9. The curved concrete formwork of claim 1, wherein said bolt fixture is rigidly connected to remaining portions of said transverse bolt, is welded to said remaining portions, or is formed by an end of said first transverse bolt.

10. The curved concrete formwork of claim 1, wherein said first connecting means has a left-hand thread and said second connection means has a right-hand thread.

11. The curved concrete formwork of claim 1, wherein the curved concrete formwork is formed from formwork elements which comprise support elements and edge support elements which are mounted to a formwork shell and to which the transverse bolts are mounted via bolt fixtures thereof.

12. The curved concrete formwork of claim 11, wherein said support elements have recesses for passage of tie bolts, for mounting working platforms, and/or for connecting arbitrary connecting elements.

13. The curved concrete formwork of claim 11, wherein an edge transverse bolt is mounted to an edge support element, said edge support element comprising a resilient shackle disposed on a side of said edge support element facing away from an edge of said formwork shell, wherein said shackle is mounted to said formwork shell and designed to follow a bending direction of said formwork shell, when loaded by said transverse bolts and said edge transverse bolts.

* * * * *